US007182342B1

(12) United States Patent
Fulton, Jr.

(10) Patent No.: US 7,182,342 B1
(45) Date of Patent: Feb. 27, 2007

(54) MATH BOARD GAME

(76) Inventor: Verdell Fulton, Jr., P.O. Box 4762, Beaufort, SC (US) 29903

( * ) Notice: Subject to any disclaimer, the term of this patent is extended or adjusted under 35 U.S.C. 154(b) by 0 days.

(21) Appl. No.: 11/386,430

(22) Filed: Mar. 22, 2006

(51) Int. Cl.
*A63F 9/04* (2006.01)

(52) U.S. Cl. ..... 273/272; 273/299; 434/191; 434/128

(58) Field of Classification Search ..... 273/272, 273/302, 299, 141 R, 142 R, 142 A–142 G, 273/142 J, 142 JA, 142 JC; 434/128, 188, 434/191, 198
See application file for complete search history.

(56) References Cited

U.S. PATENT DOCUMENTS

| | | | | |
|---|---|---|---|---|
| 1,099,563 | A | 6/1914 | Meyers | |
| 2,871,581 | A * | 2/1959 | Guzak | 273/236 |
| 4,114,290 | A * | 9/1978 | Cooper | 434/200 |
| 4,196,904 | A * | 4/1980 | Bailey | 273/256 |
| 4,258,922 | A * | 3/1981 | Landry | 273/302 |
| 4,568,086 | A * | 2/1986 | Krogh | 273/141 R |
| 5,176,381 | A * | 1/1993 | Winters | 273/146 |
| 5,281,144 | A | 1/1994 | Pease | |
| 6,199,864 | B1 | 3/2001 | Branner | |
| 6,299,166 | B1 * | 10/2001 | Factor | 273/146 |
| 6,341,779 | B1 * | 1/2002 | Merritt | 273/292 |
| 6,811,402 | B1 * | 11/2004 | Ritchie | 434/191 |
| 2006/0197281 | A1 * | 9/2006 | Waid et al. | 273/242 |

OTHER PUBLICATIONS

Math Games, Sum Swamp Math Game, found at website; http://www.educationallearninggames.com/math-game-sum-swamp-math-game.asp, 2003.*

Leaping Lilypad Game, found at website;http://www.amazon.com/Great-American-Sales-Leaping-Lilypad/dp/B000053FAF, 2002.*

* cited by examiner

*Primary Examiner*—William M. Pierce

(57) ABSTRACT

A game for teaching arithmetic skills involves having a player spin a wheel twice, the first time determines the arithmetic operation to be performed and the first number and the second spin determines the second number. The player then moves his or her game piece according to the results of the arithmetic operation, if the player correctly performs the operation and obtains the correct result. The player will forfeit his turn if he incorrectly performs the operation. Rules of the game control the direction of movement of the game pieces and the number of spaces the game piece can be moved on any one turn. A winner is determined by the first player to reach a finish position.

11 Claims, 3 Drawing Sheets

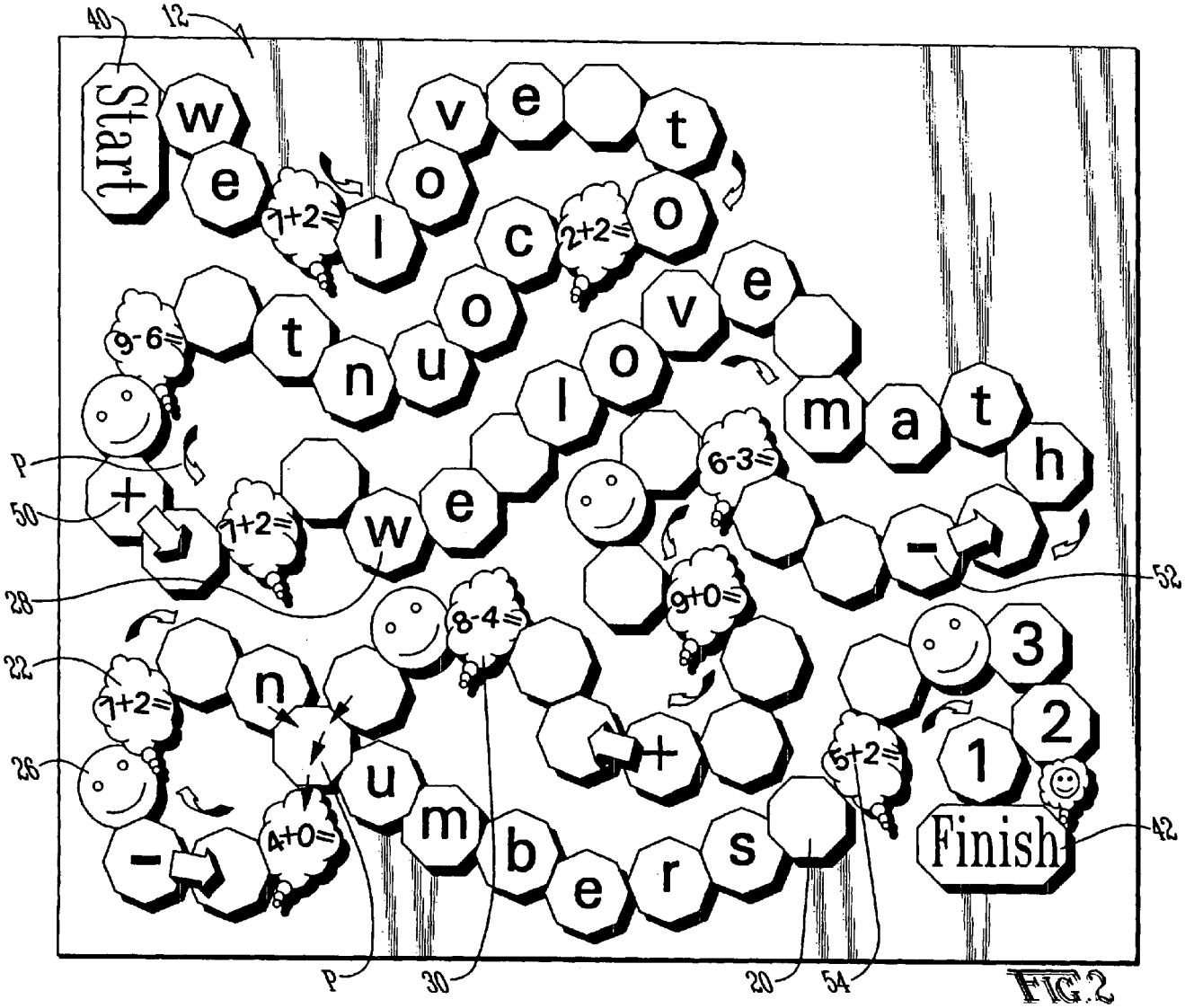
Start
Finish
w e l c o m e t o v e r b a l n u m b e r s
1 2 3
1+2=
9-6=
2+2=
9-3=
5+0=
9+2=
8-4=
4+0=
1+2=
1+2=
1+2=
+
-
+
-
+
-

MATH BOARD GAME

TECHNICAL FIELD OF THE INVENTION

The present invention relates generally to a board game and, more particularly, to a board game that teaches mathematics.

BACKGROUND OF THE INVENTION

Fundamental mathematical operations, namely, addition, subtraction, multiplication and division, are taught to young children during their early years of elementary education. However, arithmetic and mathematical skills are often difficult for children to acquire. The abstract use and manipulation of numbers is not generally an inherently obvious operation to most children, and the application of such operations to something which they can readily see or use is often of great assistance in teaching basic arithmetic and mathematics to children and others.

Early development of mathematical skills is crucial to children. Unless mathematical skills are understood at an early age, problems in learning math may grow as a child continues his or her schooling. In many instances, young children are taught to memorize concepts without really understanding what it is that they are learning. For instance, children are often encouraged to memorize multiplication tables as a way to understand multiplication. What often occurs is that children fail to completely memorize all the various permutations, leaving one or more combinations that go unlearned. Frustration may develop if the unlearned combinations are not overcome, leading to a lack of confidence when learning new mathematical concepts in future years. Students' self esteem may suffer as a result of not understanding more and more complex mathematical concepts. As a result, children often perform poorly in math throughout their middle school and high school years. Teachers and parents may lower their expectations in response to a child's poor performance, and the failure perpetuates itself.

The inventor is aware of various devices and games which have been suggested in an effort to teach mathematical skills to children and others, for example various types of numerical games are known as an aid to teaching such children simple arithmetic equations. For example, flash cards, wherein a simple equation such as "3 times 3" is displayed on a front surface of the card with the answer on the rear surface, have been employed as a useful aid. A single card usually contains one equation, and a large number of cards are required to effectively aid the student. These cards can be misplaced or lost, and may also be bulky to handle or transport.

Still further, the inventor is aware of various board games which have been designed to promote learning of basic mathematical skills. Many times, it is the purpose of these games to provide a challenge to the player which will test mathematical and reasoning skills. However, most of these games are targeted at a limited age range and only focus on a narrow range of mathematical skills to be learned. For example, many mathematical games are targeted at preschool children and teach basic addition and subtraction skills. Other games are targeted at elementary school students and teach more complicated skills, such as multiplication, division, and fractions. Such games are not suitable for players who do not fall within the targeted age group for the specific game in question. In addition, most of these mathematical teaching games require at least basic mathematical skills prior to playing. Without basic mathematical skills, most mathematical games, even those geared towards young children, are not suitable for very young players. As a result, critical mathematical skills are not learned as early in life as might be otherwise. In general, older children become bored quickly with games that are designed for younger players, and younger children become frustrated and lose interest quickly in games that are too advanced for them. One other drawback to most mathematical games is that once they are played several times, the answers are known and the novelty wears out quickly.

Therefore, there is a need for an entertaining mathematical board game which enables players of virtually any age to play, even if those players have only rudimentary math skills. The game should also approach mathematical learning from an interesting and helpful point of view to reduce anxiety when learning new math skills and allowing players to develop strategic skills as well.

SUMMARY OF THE INVENTION

The above-discussed disadvantages of the prior art are overcome by a game that is played in a manner that permits young children to learn arithmetic skills in a manner that will retain their attention as well as challenge them and effectively teach them arithmetic skills in an enjoyable manner.

The game involves having a player spin a wheel twice, the first time determines the arithmetic operation to be performed and the first number and the second spin determines the second number. The player then moves his or her game piece according to the results of the arithmetic operation, if the player correctly performs the operation and obtains the correct result. The player will forfeit his turn if he incorrectly performs the operation. Rules of the game control the direction of movement of the game pieces and the number of spaces the game piece can be moved on any one turn. A winner is determined by the first player to reach a finish position.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 2 is a plan view showing the layout of the position indicators on the game board used in the game.

DETAILED DESCRIPTION OF THE INVENTION

Figure 3:
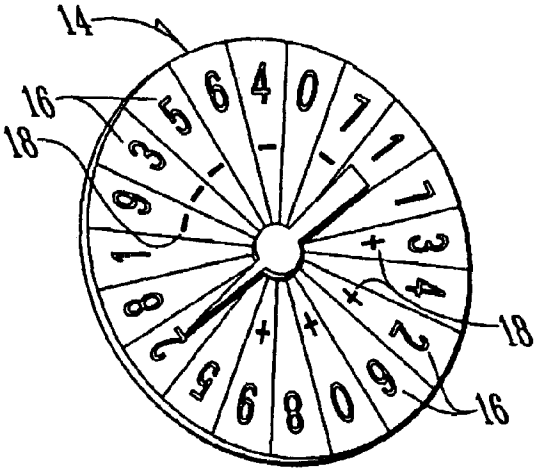
FIG. 3 is a detail view showing a spinning wheel used in the game embodying the present invention.
Figure 1:
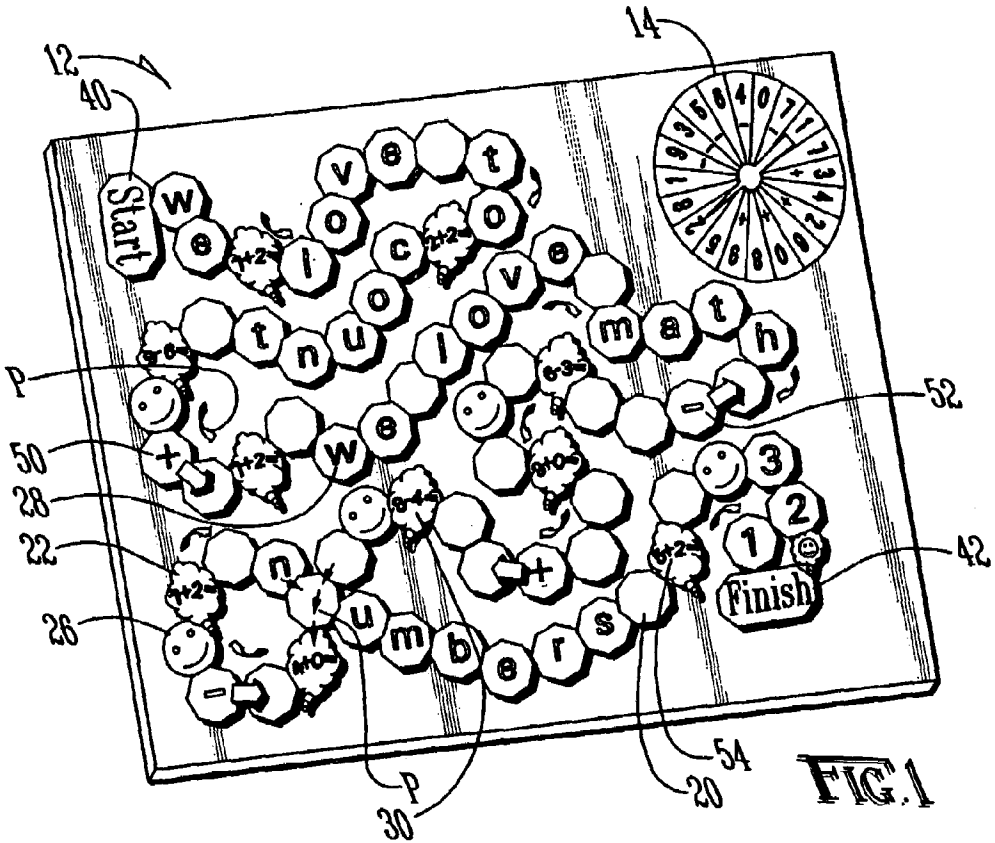
FIG. 1 is a perspective view of a game board used in the game embodying the present invention.

Referring to the figures, it can be understood that the present invention is embodied in a game that is intended to teach math skills, specifically arithmetic skills in a pleasant, efficient manner.

The game is played using a game board 12 which is planar and foldable in the well-known manner of game boards. A spinning wheel 14 is located on the game board and includes a spinable pointer that is rotationably mounted and has a knob or the like which is grasped to spin the pointer. Having a knob will help small children operate the spinner. A plurality of numbers 16, such as numbers from 0 to 9 are located circumjacent to the spinning wheel and a plurality of arithmetic operations 18, such as addition, subtraction, multiplication, fractions, division, and combination thereof are located circumjacent to the numbers and to the spinning wheel.

A plurality of position indicators, such as area 20, are located on the game board and are arranged in a tortuous path P on the game board. Some of the indicators, such as area 22, have written material 24 therein. The written material can include drawings, such as drawing 26, letters, such as letter 28, or the like. Some of the areas, such as area 30, can be in various shapes, such as cloud shaped or the like. This material is used to encourage the players, by providing positive reinforcement to their moves.

A "start" position indicator 40 is located on the game board adjacent to one of the position indicators and a "finish" position indicator 42 is located on the game board adjacent to a second position indicator.

Figure 4:
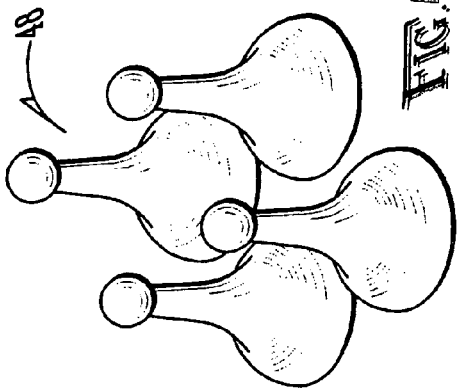
FIG. 4 shows game pieces used in the game embodying the present invention.

As indicated in FIG. 4, the game includes a plurality of game pieces, such as game piece 50, and each player has one of the game pieces assigned to him. The game is played by two to four players, or more if desired.

The game is begun with all of the player game pieces located in the "start" area.

The game is initiated by selecting one of the players to begin play. The selected player spins the spinning wheel a first time to determine which arithmetic operation is to be performed and a first number.

The selected player spins the spinning wheel a second time to determine a second number for the determined arithmetic operation.

In one form of the game, a value is assigned to each of arithmetic operation. That is, for example, addition can have a value of +3, or multiplication can have a value of +5, etc.

Once the player has determined the operation and the numbers involved, the player performs the determined arithmetic operation on the first and second numbers.

If the player correctly performs the determined arithmetic operation on the first and second numbers and obtains the correct result, that player advances his game piece from the "start" position indicator a number of position indicators equal to the value assigned to the arithmetic operation correctly performed by the player. In one form of the game, there is a maximum number of spaces that can be moved. For example, a maximum of nine spaces can be moved at one time. In some cases, the number of spaces that can be moved corresponds to the result of the arithmetic operation (e.g., 3+4=7), with the player thus moving seven spaces upon obtaining the correct answer, with nine being the maximum number of spaces that the player can move no matter what the correct result will be (e.g., 8+9=17), with the player then being permitted to move only nine spaces).

In one form of the game, special values are assigned to results of selected arithmetic operations. For example, if a correct result is zero, the player may be permitted to move three spaces so he will not lose a turn for obtaining a correct answer.

As just explained, if the player correctly performs an arithmetic operation and the result of the operation is one of the results of the selected operations the player will advance his game piece toward the "finish" position indicator along the position indicators a number of positions equal to the special value associated with the result of the selected arithmetic operation.

In one form of the game, the player will move his game piece in a direction toward the "finish" position indicator if the correct result of the arithmetic operation is a positive number and move his game piece in an opposite direction toward the "start" position indicator if the correct result of the arithmetic operation is a negative number. In one form of the game, the player can move an opponent's game piece back toward the "start" position a number of spaces equal to the correct result if the correct result is a negative number.

A player will forfeit his turn if he does not correctly perform the arithmetic operation.

In one form of the game, some of the position indicators have an addition or a subtraction sign thereon, such as indicators 50 and 52. If a player lands on an indicator having a plus sign, such as indicator 50, the player will be permitted to advance a free space; whereas, if the player lands on an indicator having a minus sign, such as indicator 52, that player will be required to move back one space. Some of the position indicators can have a math problem thereon. For example, position indicator 54 has an addition problem thereon. If a player lands on these indicators, he will receive another chance to solve the problem and move on in a manner exactly like he had spun the spinner wheel, e.g., if a player lands on indicators 54, he will receive a bonus turn.

A second player follows the first player and play proceeds as disclosed above for each player. Play continues until a player reaches the "finish" position indicator, and that player is declared to be the winner. The game can be in either English or Spanish, and can be limited to only addition and subtraction if desired.

Figure 5:
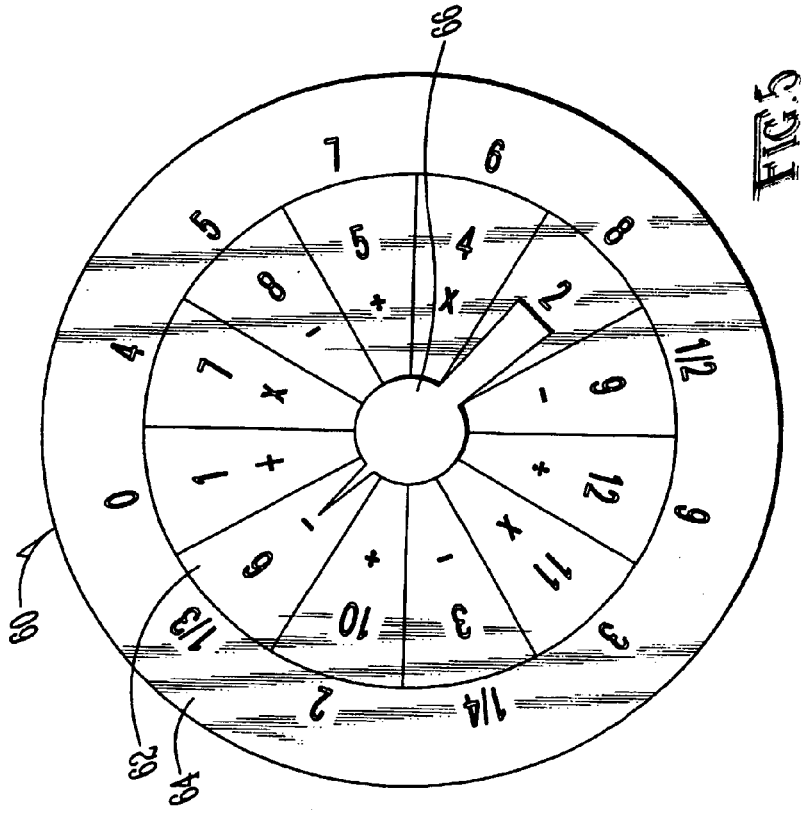
FIG. 5 shows another spinning wheel.

FIG. 5 shows a spinning wheel 60 that can be also used with the game. The spinning wheel 60 has an inner wheel 62 and an outer wheel 64 where the two wheels 62 and 64 may rotate relative to each other so that different combination of numbers may be adjacent to each other by spinning the inner wheel 62 relative to the outer wheel 64, for example. The spinning wheel also has a spinner 66 that can be rotated by a player relative to the inner wheel 62. For example, FIG. 5 shows that player must solve the following arithmetic operation (6−⅓). This way, a different combination of numbers and different arithmetic operations may be asked from a player depending on the spin of the spinner 66 to play the game as discussed above.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method of teaching math skills comprising:

A) providing a game board;

B) placing a spinning wheel on the game board;

C) placing a plurality of numbers circumjacent to the spinning wheel;

D) placing a plurality of arithmetic operations circumjacent to the numbers and to the spinning wheel;

E) placing a plurality of position indicators on the game board and arranging the indicators in a tortuous path on the game board;

F) placing a "start" position indicator on the game board adjacent to one of the position indicators;

G) placing a "finish" position indicator on the game board adjacent to a second position indicator;

H) providing a plurality of game pieces;

I) providing a plurality of players and assigning one game piece to each player and placing all of the game pieces in the "start" position indicator;

J) selecting one of the players to begin play;

K) having the selected player spin the spinning wheel a first time to determine which arithmetic operation is to be performed and a first number;

L) having the selected player spin the spinning wheel a second time to determine a second number for the determined arithmetic operation;

M) assigning a value to each of arithmetic operation;

N) having the player performing the determined arithmetic operation on the first and second numbers;

O) if the player correctly performs the determined arithmetic operation on the first and second numbers, having the player advance his game piece from the "start" position indicator a number of position indicators equal to the value assigned to the arithmetic operation correctly performed by the player;

P) assigning special values to results of selected arithmetic operations;

Q) if the player correctly performs an arithmetic operation and the result of the operation is one of the results of the selected operations having the player advance his game piece toward the "finish" position indicator along the position indicators a number of positions equal to the special value associated with the result of the selected arithmetic operation;

R) placing a maximum on the number of position indicators that the player can move his game piece on any single turn;

S) having the player move his game piece in a direction toward the "finish" position indicator if the correct result of the arithmetic operation is a positive number and move his game piece in an opposite direction toward the "start" position indicator if the correct result of the arithmetic operation is a negative number;

T) having the player forfeit his turn if he does not correctly perform the arithmetic operation;

U) having a second player follow the first player; and

V) declaring the first player to reach the "finish" position indicator to be a winner.

2. The method defined in claim 1 further including placing printed material on the board in selected ones of the position indicators.

3. The method defined in claim 2 wherein the arithmetic operations include addition and subtraction.

4. The method defined in claim 2 wherein the arithmetic operations include multiplications.

5. The method defined in claim 2 wherein the arithmetic operations include divisions.

6. The method defined in claim 2 wherein the arithmetic operations include fractions.

7. The method defined in claim 2 wherein the printed material is in Spanish.

8. The method defined in claim 1 further including placing a "+" sign on one of the position indicators and a "−" sign on another position indicator, and the method includes requiring a player landing on the position indicator with a "+" sign to move toward the "finish" position indicator a predetermined number of position indicators, and further includes a player landing on a position indicator with a "−" sign to move toward the "start" position indicator a predetermined number of position indicators.

9. The method defined in claim 8 wherein the predetermined number of position indicators is one.

10. The method defined in claim 1 further including placing a math problem on one of the position indicators and the method further includes providing a player landing on the indicator with the math problem a bonus turn based on the math problem on the position indicator.

11. The method defined in claim 1 where the spinning wheel has an outer wheel to associate with the plurality of numbers circumjacent to the spinning wheel to provide different combination of numbers.

* * * * *